US010263332B2

(12) United States Patent
Yong et al.

(10) Patent No.: US 10,263,332 B2
(45) Date of Patent: Apr. 16, 2019

(54) ANTENNA ARRAYS WITH ETCHED SUBSTRATES

(71) Applicant: Apple Inc., Cupertino, CA (US)

(72) Inventors: Siwen Yong, San Francisco, CA (US); Yi Jiang, Cupertino, CA (US); Jiangfeng Wu, San Jose, CA (US); Lijun Zhang, San Jose, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 11 days.

(21) Appl. No.: 15/707,721

(22) Filed: Sep. 18, 2017

(65) Prior Publication Data

US 2019/0089052 A1 Mar. 21, 2019

(51) Int. Cl.

| | |
|---|---|
| ***H01Q 3/34*** | (2006.01) |
| ***H01Q 9/04*** | (2006.01) |
| ***H01Q 21/06*** | (2006.01) |
| ***H01Q 21/28*** | (2006.01) |
| ***H01Q 1/22*** | (2006.01) |
| ***H01Q 1/38*** | (2006.01) |
| ***H01Q 1/42*** | (2006.01) |
| ***H01Q 1/24*** | (2006.01) |
| ***H01Q 21/00*** | (2006.01) |

(52) U.S. Cl.

CPC ..... *H01Q 3/34* (2013.01); *H01Q 1/2266* (2013.01); *H01Q 1/2283* (2013.01); *H01Q 1/243* (2013.01); *H01Q 1/38* (2013.01); *H01Q 1/42* (2013.01); *H01Q 9/0407* (2013.01); *H01Q 21/0025* (2013.01); *H01Q 21/065* (2013.01); *H01Q 21/28* (2013.01)

(58) Field of Classification Search

CPC ..... H01Q 3/34; H01Q 1/2266; H01Q 1/38; H01Q 5/10

USPC ..... 343/778

See application file for complete search history.

(56) References Cited

U.S. PATENT DOCUMENTS

| | | | | |
|---|---|---|---|---|
| 8,072,384 | B2 * | 12/2011 | Morrow | H01Q 21/0025 343/700 MS |
| 8,766,855 | B2 | 7/2014 | Biglarbegian et al. | |
| 9,667,290 | B2 | 5/2017 | Ouyang et al. | |

(Continued)

*Primary Examiner* — Peguy Jean Pierre

(74) *Attorney, Agent, or Firm* — Treyz Law Group, P.C.; Joseph F. Guihan

(57) ABSTRACT

An electronic device may be provided with wireless communications circuitry and control circuitry. The wireless communications circuitry may include centimeter and millimeter wave transceiver circuitry and a phased antenna array. A dielectric cover may be formed over the phased antenna array. The phased antenna array may transmit and receive antenna signals through the dielectric cover. The dielectric cover may have first and second opposing surfaces. The second surface may face the phased antenna array and may have a curvature. The antenna elements of the phased antenna array may be formed on a dielectric substrate. The dielectric substrate may have one or more thinned regions between antenna elements of the phased antenna array to promote bending. The dielectric substrate may have a smaller thickness in the thinned region than in the regions under the antenna elements. The dielectric substrate may be totally removed in the thinned region.

16 Claims, 18 Drawing Sheets

(56) References Cited

U.S. PATENT DOCUMENTS

| | | | | |
|---|---|---|---|---|
| 2005/0030244 | A1* | 2/2005 | Durham | H01Q 9/0442 343/795 |
| 2006/0099738 | A1* | 5/2006 | Yamazaki | H01L 21/486 438/114 |
| 2015/0097634 | A1* | 4/2015 | Ghassemi | H01P 5/028 333/34 |
| 2017/0027177 | A1 | 2/2017 | Amaki et al. | |
| 2017/0264008 | A1 | 9/2017 | Ying et al. | |

* cited by examiner

ANTENNA ARRAYS WITH ETCHED SUBSTRATES

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation through various mediums.

It would therefore be desirable to be able to provide electronic devices with improved wireless communications circuitry such as communications circuitry that supports millimeter wave communications.

SUMMARY

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antenna elements may be arranged in a phased antenna array.

A dielectric cover (sometimes referred to herein as a radome) may be formed over the antenna elements in the phased antenna array. The phased antenna array may transmit and receive a beam of signals through the dielectric cover and may steer the signals over a corresponding field of view. The dielectric cover may have a first surface and a second opposing surface that faces the phased antenna array. The second surface may be a curved surface (e.g., may include a curve).

The antenna elements of the phased antenna array may be formed on a dielectric substrate. The dielectric substrate may have one or more thinned regions between antenna elements of the phased antenna array to promote bending. The thinned regions may include a notch in the dielectric substrate such that the dielectric substrate has a smaller thickness between antenna elements than under the antenna elements. The dielectric substrate may be totally removed in the thinned region.

A ground layer may be coupled to the dielectric substrate. The ground layer may be bent at the thinned portion of the dielectric substrate. The phased antenna array may also include transmission line structures. Each transmission line structure may be coupled to a respective antenna element of the phased antenna array through the dielectric substrate.

DETAILED DESCRIPTION

Electronic devices may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF)

communications, involve signals at 60 GHz or other frequencies between about 30 GHz and 300 GHz. Centimeter wave communications involve signals at frequencies between about 10 GHz and 30 GHz. While uses of millimeter wave communications may be described herein as examples, centimeter wave communications, EHF communications, or any other types of communications may be similarly used. If desired, electronic devices may also contain wireless communications circuitry for handling satellite navigation system signals, cellular telephone signals, local wireless area network signals, near-field communications, light-based wireless communications, or other wireless communications.

Electronic devices (such as device 10 in FIG. 1) may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station (e.g., a wireless router or other equipment for routing communications between other wireless devices and a larger network such as the internet or a cellular telephone network), a desktop computer, a keyboard, a gaming controller, a computer mouse, a mousepad, a trackpad or touchpad, equipment that implements the functionality of two or more of these devices, or other electronic equipment. The above-mentioned examples are merely illustrative. Other configurations may be used for electronic devices if desired.

Figure 1:
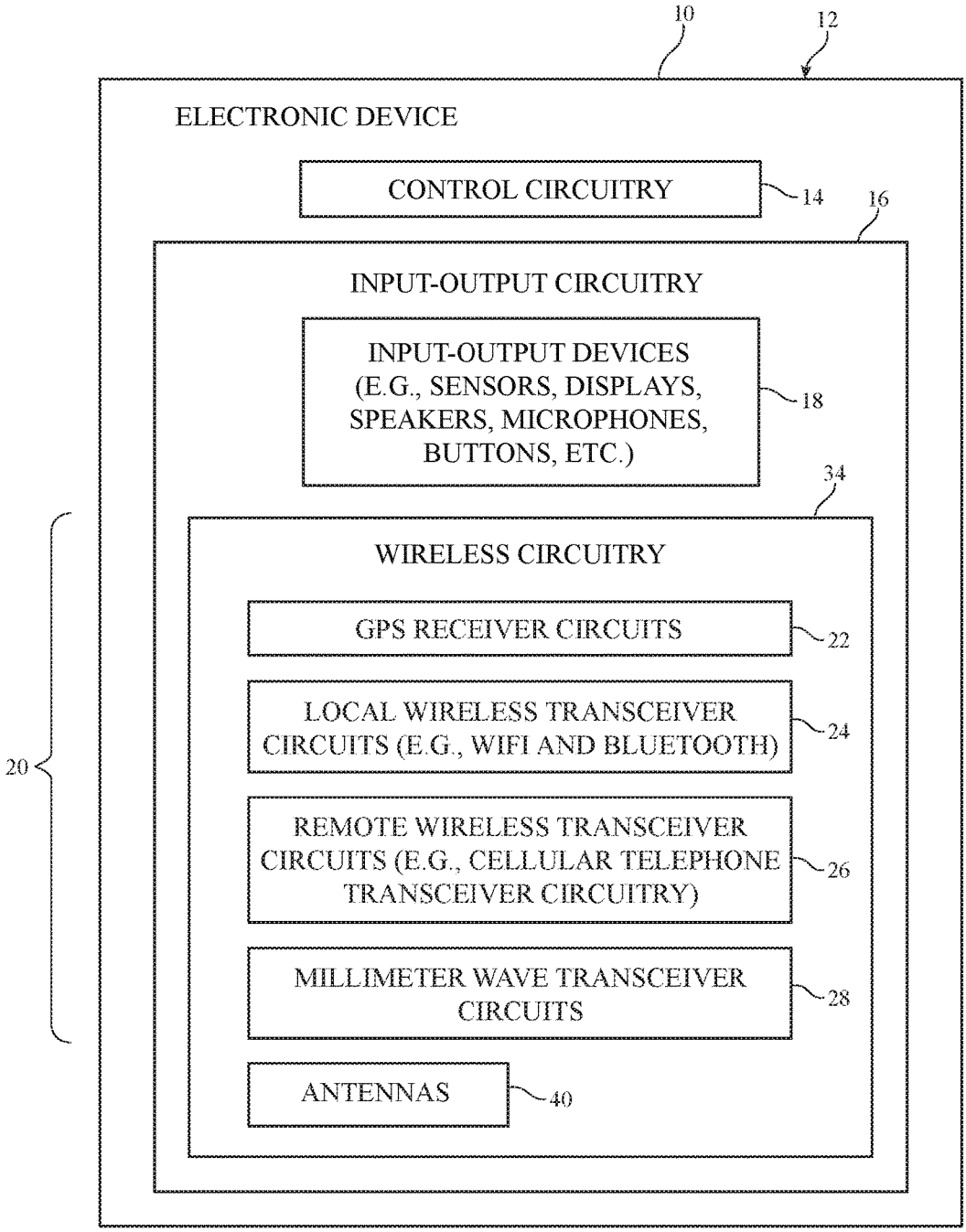
FIG. 1 is a schematic diagram of an illustrative electronic device with wireless communications circuitry in accordance with an embodiment.

A schematic diagram showing illustrative components that may be used in an electronic device such as electronic device 10 is shown in FIG. 1. As shown in FIG. 1, device 10 may include storage and processing circuitry such as control circuitry 14. Control circuitry 14 may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a low communications band from 700 to 960 MHz, a midband from 1710 to 2170 MHz, a high band from 2300 to 2700 MHz, a ultra-high band from 3400 to 3700 MHz, or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a Ku communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or 5th generation mobile networks or 5th generation wireless systems (5G) communications bands between 27 GHz and 90

GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals that travel (over short distances) between a transmitter and a receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can include phased antenna arrays for handling millimeter wave communications.

As shown in FIG. 1, device 10 may include a housing such as housing 12. Housing 12, which may sometimes be referred to as an enclosure or case, may be formed of plastic, glass, ceramics, fiber composites, metal (e.g., stainless steel, aluminum, metallic coatings on a substrate, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Antennas 40 may be mounted in housing 12. Dielectric-filled openings such as plastic-filled openings may be formed in metal portions of housing 12 (e.g., to serve as antenna windows and/or to serve as gaps that separate portions of antennas 40 from each other).

In scenarios where input-output devices 18 include a display, the display may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures. The display may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. The display may be protected using a display cover layer such as a layer of transparent glass, clear plastic, sapphire, or other transparent dielectric. If desired, some of the antennas 40 (e.g., antenna arrays that may implement beam steering, etc.) may be mounted under an inactive border region of the display. The display may contain an active area with an array of pixels (e.g., a central rectangular portion). Inactive areas of the display are free of pixels and may form borders for the active area. If desired, antennas may also operate through dielectric-filled openings elsewhere in device 10.

If desired, housing 12 may include a conductive rear surface. The rear surface of housing 12 may lie in a plane that is parallel to a display of device 10. In configurations for device 10 in which the rear surface of housing 12 is formed from metal, it may be desirable to form parts of peripheral conductive housing structures as integral portions of the housing structures forming the rear surface of housing 12. For example, a rear housing wall of device 10 may be formed from a planar metal structure, and portions of peripheral housing structures on the sides of housing 12 may be formed as vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions. The peripheral housing structures and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide internal structures from view of the user).

Transmission line paths may be used to route antenna signals within device 10. For example, transmission line paths may be used to couple antenna structures 40 to transceiver circuitry 20. Transmission lines in device 10 may include coaxial cable paths, microstrip transmission lines, stripline transmission lines, edge-coupled microstrip transmission lines, edge-coupled stripline transmission lines, waveguide structures for conveying signals at millimeter wave frequencies, transmission lines formed from combinations of transmission lines of these types, etc. Transmission lines in device 10 may be integrated into rigid and/or flexible printed circuit boards. In one suitable arrangement, transmission lines in device 10 may also include transmission line conductors (e.g., signal and ground conductors) integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintains a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may include antenna arrays (e.g., phased antenna arrays to implement beam steering functions). For example, the antennas that are used in handling millimeter wave signals for extremely high frequency wireless transceiver circuits 28 may be implemented as phased antenna arrays. The radiating elements in a phased antenna array for supporting millimeter wave communications may be patch antennas, dipole antennas, Yagi (Yagi-Uda) antennas, or other suitable antenna elements. Transceiver circuitry 28 can be integrated with the phased antenna arrays to form integrated phased antenna array and transceiver circuit modules or packages if desired.

In devices such as handheld devices, the presence of an external object such as the hand of a user or a table or other surface on which a device is resting has a potential to block wireless signals such as millimeter wave signals. In addition, millimeter wave communications typically require a line of sight between antennas 40 and the antennas on an external device. Accordingly, it may be desirable to incorporate multiple phased antenna arrays into device 10, each of which is placed in a different location within or on device 10. With this type of arrangement, an unblocked phased antenna array may be switched into use and, once switched into use, the phased antenna array may use beam steering to optimize wireless performance. Similarly, if a phased antenna array does not face or have a line of sight to an external device, another phased antenna array that has line of sight to the external device may be switched into use and that phased antenna array may use beam steering to optimize wireless performance. Configurations in which antennas from one or more different locations in device 10 are operated together may also be used (e.g., to form a phased antenna array, etc.).

Figure 2:
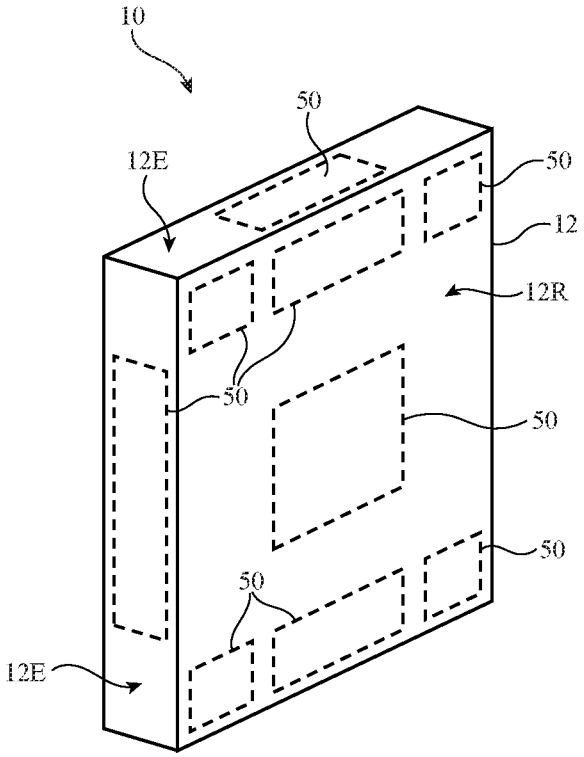
FIGS. 2 and 3 are perspective views of an illustrative electronic device showing locations at which phased antenna arrays for millimeter wave communications may be located in accordance with an embodiment.

FIG. 2 is a perspective view of electronic device 10 showing illustrative locations 50 at which antennas 40 (e.g., single antennas and/or phased antenna arrays for use with wireless circuitry 34 such as millimeter wave wireless transceiver circuitry 28) may be mounted in device 10. As shown in FIG. 2, housing 12 of device 10 may include rear housing wall 12R and housing sidewalls 12E. In one suitable arrangement, a display may be mounted to the side of housing 12 opposing rear housing wall 12R.

Antennas 40 (e.g., single antennas 40 or arrays of antennas 40) may be mounted at locations 50 at the corners of device 10, along the edges of housing 12 such as on sidewalls 12E, on the upper and lower portions of rear housing portion 12R, in the center of rear housing 12 (e.g., under a dielectric window structure such as a plastic logo), etc. In configurations in which housing 12 is formed from a dielectric, antennas 40 may transmit and receive antenna signals through the dielectric, may be formed from conductive structures patterned directly onto the dielectric, or may be formed on dielectric substrates (e.g., flexible printed circuit board substrates) formed on the dielectric. In configurations in which housing 12 is formed from a conductive material such as metal, slots or other openings may be formed in the metal that are filled with plastic or other dielectric. Antennas 40 may be mounted in alignment with the dielectric (i.e., the dielectric in housing 12 may serve as one or more antenna windows for antennas 40) or may be formed on dielectric substrates (e.g., flexible printed circuit board substrates) mounted to external surfaces of housing 12.

Figure 3:
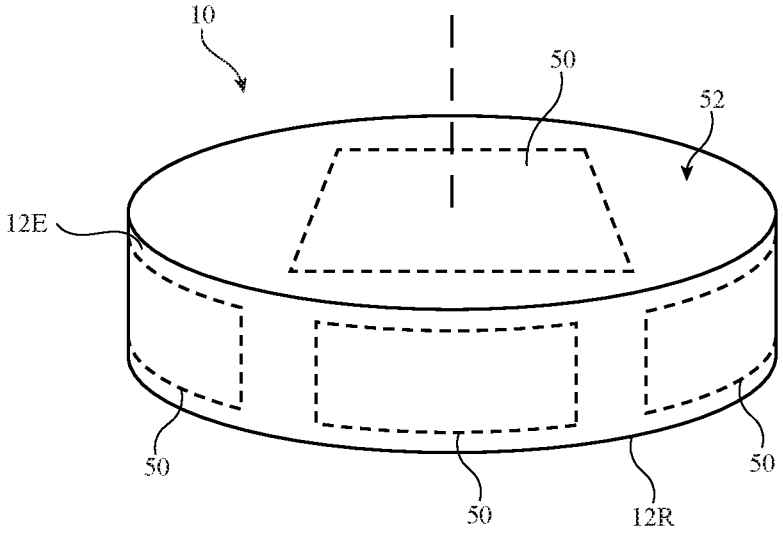

In the example of FIG. 2, rear housing wall 12R has a rectangular periphery. Housing sidewalls 12E surround the rectangular periphery of wall 12R and extend from wall 12R to the opposing face of device 10. In another suitable arrangement, device 10 and housing 12 may have a cylindrical shape. As shown in FIG. 3, rear housing wall 12R has a circular or elliptical periphery. Rear housing wall 12R may oppose surface 52 of device 10. Surface 52 may be formed from a portion of housing 12, may be formed from a display or transparent display cover layer, or may be formed using any other desired device structures. Housing sidewall 12E may extend between surface 52 and rear housing wall 12R. Antennas 40 may be mounted at locations 50 along housing sidewall 12E, on surface 52, and/or on wall 12R. By forming phased antenna arrays at different locations along wall 12E, on surface 52 (sometimes referred to herein as housing surface 52), and/or on rear housing wall 12R (e.g., as shown in FIGS. 2 and 3), the different phased antenna arrays on device 10 may collectively provide line of sight coverage to any point on a sphere surrounding device 10 (or on a hemisphere surrounding device 10 in scenarios where phased antenna arrays are only formed on one side of device 10).

The examples of FIGS. 2 and 3 are merely illustrative. In general, housing 12 and device 10 may have any desired shape or form factor. For example, rear housing wall 12R may have a triangular periphery, hexagonal periphery, polygonal periphery, a curved periphery, combinations of these, etc. Housing sidewall 12E may include straight portions, curved portions, stepped portions, combinations of these, etc. If desired, housing 12 may include other portions having any other desired shapes. The height of sidewall 12E may be less than, equal to, or greater than the length and/or width of housing rear wall 12R.

Figure 4:
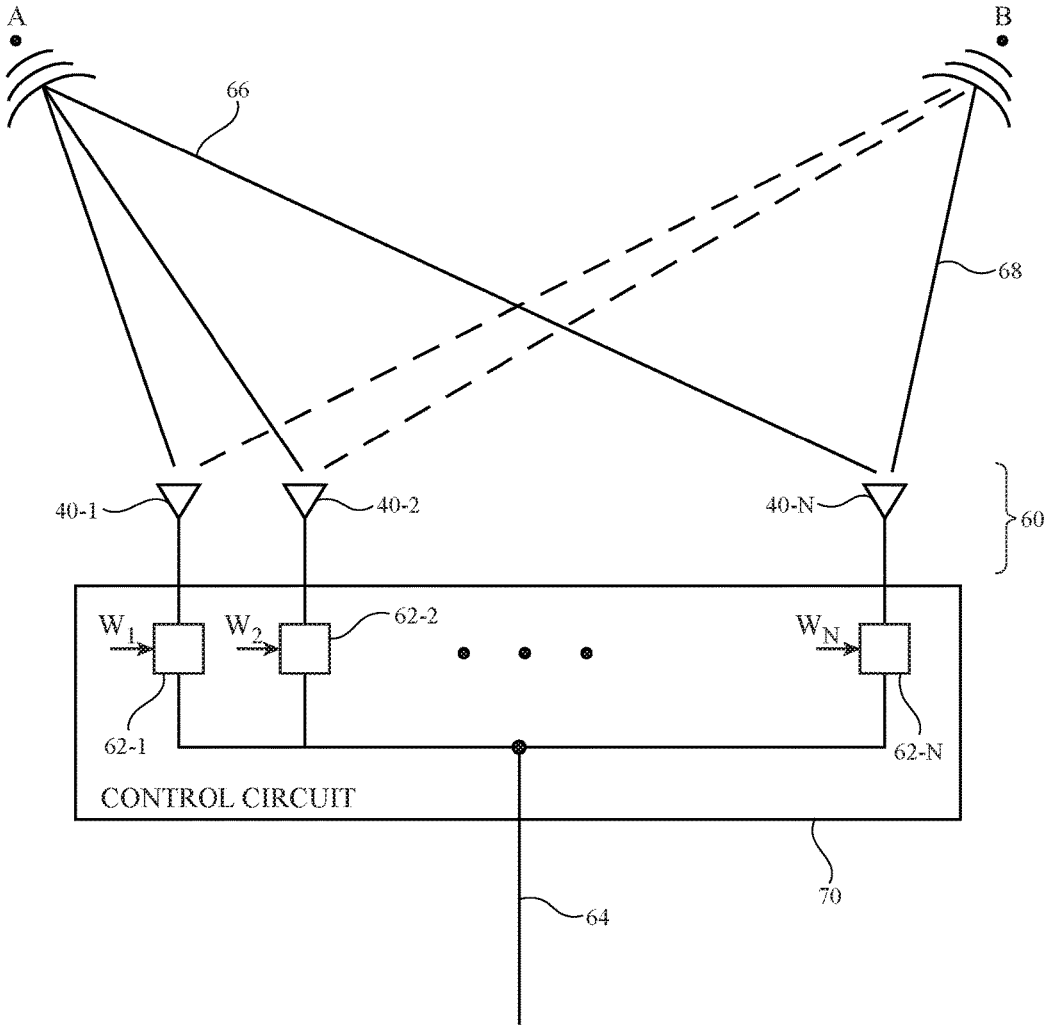
FIG. 4 is a diagram of an illustrative phased antenna array that may be adjusted using control circuitry to direct a beam of signals in accordance with an embodiment.

FIG. 4 shows how antennas 40 on device 10 may be formed in a phased antenna array. As shown in FIG. 4, phased antenna array 60 (sometimes referred to herein as array 60, antenna array 60, and array 60 of antennas 40) may be coupled to a signal path such as path 64 (e.g., one or more radio-frequency transmission line structures, extremely high frequency waveguide structures or other extremely high frequency transmission line structures, etc.). Phased antenna array 60 may include a number N of antennas 40 (e.g., a first antenna 40-1, a second antenna 40-2, an Nth antenna 40-N, etc.). Antennas 40 in phased antenna array 60 may be arranged in any desired number of rows and columns or in any other desired pattern (e.g., the antennas need not be arranged in a grid pattern having rows and columns). During signal transmission operations, path 64 may be used to supply signals (e.g., millimeter wave signals) from millimeter wave transceiver circuitry 28 to phased antenna array 60 for wireless transmission to external wireless equipment. During signal reception operations, path 64 may be used to convey signals received at phased antenna array 60 from external equipment to millimeter wave transceiver circuitry 28.

The use of multiple antennas 40 in phased antenna array 60 allows beam steering arrangements to be implemented by controlling the relative phases and amplitudes of the signals for the antennas. In the example of FIG. 4, antennas 40 each have a corresponding radio-frequency phase controller 62 (e.g., a first controller 62-1 coupled between signal path 64 and first antenna 40-1, a second controller 62-2 coupled between signal path 64 and second antenna 40-2, an Nth controller 62-N coupled between path 64 and Nth antenna 40-N, etc.).

Beam steering circuitry such as control circuitry 70 may use phase controllers 62 or any other suitable phase control circuitry to adjust the relative phases of the transmitted signals that are provided to each of the antennas in the antenna array and to adjust the relative phases of the received signals that are received by the antenna array from external equipment. The term "beam" or "signal beam" may be used herein to collectively refer to wireless signals that are transmitted and received by array 60 in a particular direction. The term "transmit beam" may sometimes be used herein to refer to wireless signals that are transmitted in a particular direction whereas the term "receive beam" may sometimes be used herein to refer to wireless signals that are received from a particular direction.

If, for example, control circuitry 70 is adjusted to produce a first set of phases on transmitted millimeter wave signals, the transmitted signals will form a millimeter wave frequency transmit beam as shown by beam 66 of FIG. 4 that is oriented in the direction of point A. If, however, control circuitry 70 adjusts phase controllers 62 to produce a second set of phases on the transmitted signals, the transmitted signals will form a millimeter wave frequency transmit beam as shown by beam 68 that is oriented in the direction of point B. Similarly, if control circuitry 70 adjusts phase controllers 62 to produce the first set of phases, wireless signals (e.g., millimeter wave signals in a millimeter wave frequency receive beam) may be received from the direction of point A as shown by beam 66. If control circuitry 70 adjusts phase controllers 62 to produce the second set of phases, signals may be received from the direction of point B, as shown by beam 68. Control circuit 70 may be controlled by control circuitry 14 of FIG. 1 or by other control and processing circuitry in device 10 if desired.

In one suitable arrangement, phase controllers 62 may each include radio-frequency mixing circuitry. The phase controllers may therefore sometimes be referred to as mixers (e.g., mixers 62). Mixers 62 may receive signals from path 64 at a first input and may receive a corresponding signal weight value W at a second input (e.g., mixer 62-1 may receive a first weight $W_1$, mixer 62-2 may receive a second weight $W_2$, mixer 62-N may receive an Nth weight $W_N$, etc.). Weight values W may, for example, be provided by control circuitry 14 (e.g., using corresponding control signals) or from other control circuitry. The mixer circuitry may mix (e.g., multiply) the signals received over path 64 with the corresponding signal weight value to produce an output signal that is transmitted on the corresponding antenna. For example, a signal S may be provided to phase controllers 62 over path 64. Mixer 62-1 may output a first output signal $S*W_1$ that is transmitted on first antenna 40-1, mixer 62-2 may output a second output signal $S*W_2$ that is transmitted on second antenna 40-2, etc. The output signals transmitted by each antenna may constructively and destructively interfere to generate a beam of signals in a particular direction (e.g., in a direction as shown by beam 66 or a direction as shown by beam 68). Similarly, adjusting weights W may allow for millimeter wave signals to be received from a particular direction and provided to path 64. Different combinations of weights W provided to each mixer will steer the signal beam in different desired directions. If desired, control circuit 70 may actively adjust weights W provided to mixers 62 in real time to steer the transmit or receive beam in desired directions.

When performing millimeter wave communications, millimeter wave signals are conveyed over a line of sight path between phased antenna array 60 and external equipment. If the external equipment is located at location A of FIG. 4, circuit 70 may be adjusted to steer the signal beam towards direction A. If the external equipment is located at location B, circuit 70 may be adjusted to steer the signal beam towards direction B. In the example of FIG. 4, beam steering is shown as being performed over a single degree of freedom for the sake of simplicity (e.g., towards the left and right on the page of FIG. 4). However, in practice, the beam is steered over two degrees of freedom (e.g., in three dimensions, into and out of the page and to the left and right on the page of FIG. 4).

Figure 5:
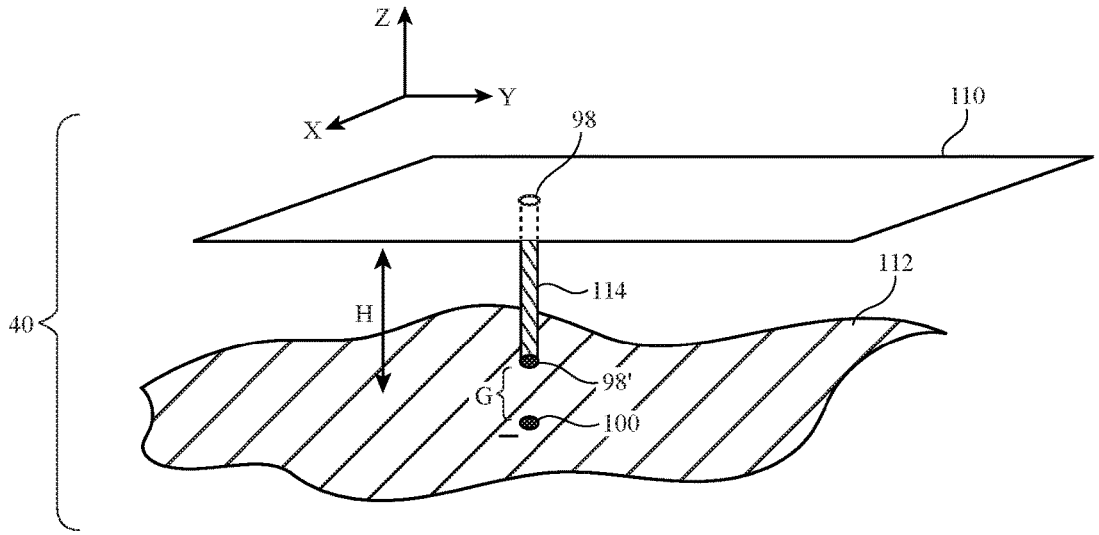
FIG. 5 is a perspective view of an illustrative patch antenna in accordance with an embodiment.

Any desired antenna structures may be used for implementing antenna 40. For example, patch antenna structures may be used for implementing antenna 40. Antennas 40 may therefore sometimes be referred to herein as patch antennas 40. An illustrative patch antenna is shown in FIG. 5. As shown in FIG. 5, patch antenna 40 may have a patch antenna resonating element such as patch 110 that is separated from a ground plane structure such as ground 112 (sometimes referred to as ground layer 112 or grounding layer 112). Antenna patch resonating element 110 and ground 112 may be formed from metal foil, machined metal structures, metal traces on a printed circuit or a molded plastic carrier, electronic device housing structures, or other conductive structures in an electronic device such as device 10.

Antenna patch resonating element 110 may lie within a plane such as the X-Y plane of FIG. 5. Ground 112 may lie within a plane that is parallel to the plane of antenna patch resonating element (patch) 110. Patch 110 and ground 112 may therefore lie in separate parallel planes that are separated by a distance H. Conductive path 114 may be used to couple terminal 98' to terminal 98. Antenna 40 may be fed using a transmission line with a positive conductor coupled to terminal 98' (and thus terminal 98) and with a ground conductor coupled to terminal 100. Other feeding arrangements may be used if desired. Moreover, patch 110 and ground 112 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.).

Figure 6:
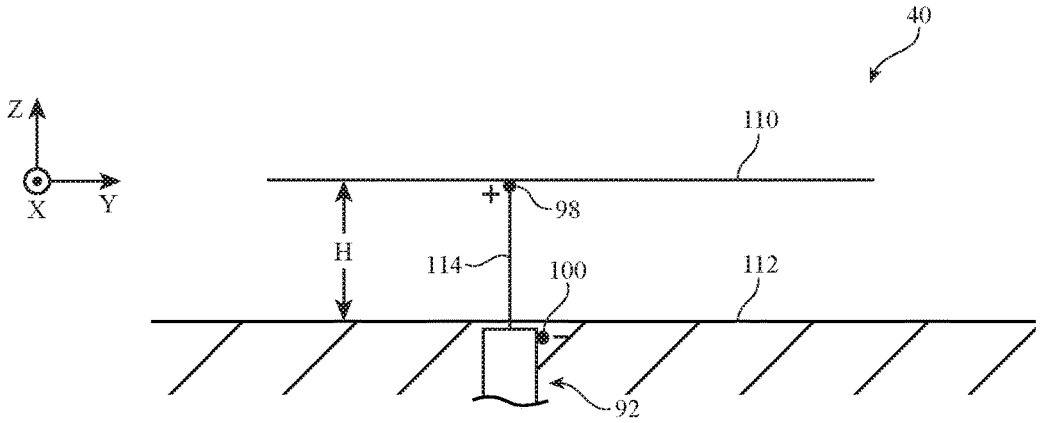
FIG. 6 is a side view of an illustrative patch antenna in accordance with an embodiment.

A side view of a patch antenna such as patch antenna 40 of FIG. 5 is shown in FIG. 6. As shown in FIG. 6, antenna 40 may be fed using an antenna feed (with terminals 98 and 100) that is coupled to a transmission line such as transmission line 92. Patch element 110 of antenna 40 may lie in a plane parallel to the X-Y plane of FIG. 6 and the surface of the structures that form ground (e.g., ground 112) may lie in a plane that is separated by vertical distance H from the plane of element 110. With the illustrative feeding arrangement of FIG. 6, a ground conductor of transmission line 92 is coupled to antenna feed terminal 100 on ground 112 and a positive conductor of transmission line 92 is coupled to antenna feed terminal 98 via an opening in ground 112 and conductive path 114 (which may be an extended portion of the transmission line's positive conductor). Other feeding arrangements may be used if desired (e.g., feeding arrangements in which a microstrip transmission line in a printed circuit or other transmission line that lies in a plane parallel to the X-Y plane is coupled to terminals 98 and 100, etc.). To enhance the frequency coverage and polarizations handled by patch antenna 40, antenna 40 may be provided with multiple feeds (e.g., two feeds) if desired. These examples are merely illustrative and, in general, the patch antenna resonating elements may have any desired shape. Other types of antennas may be used if desired.

Figure 7:
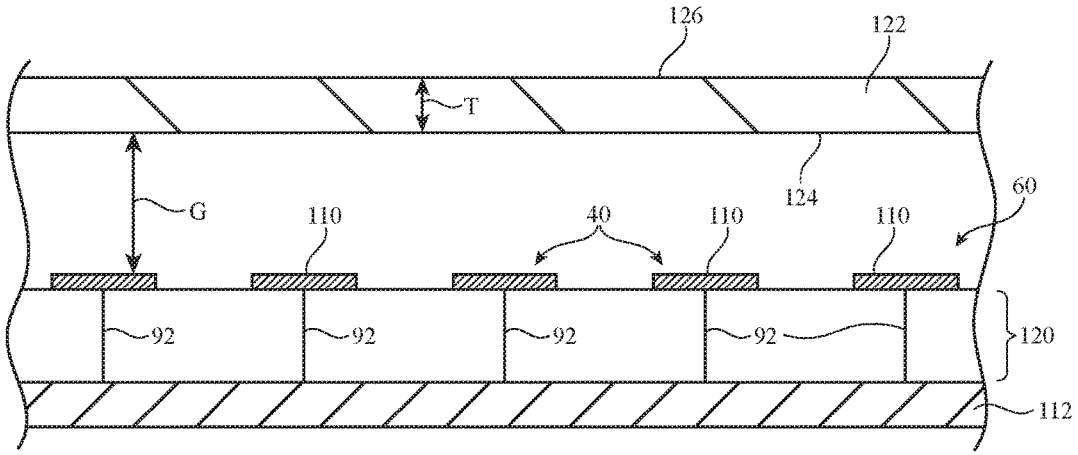
FIG. 7 is a cross-sectional side view of an illustrative planar dielectric cover formed over an antenna array in accordance with an embodiment.

Antennas of the types shown in FIGS. 5 and 6 and/or other types of antennas may be arranged in a phased antenna array such as phased antenna array 60 of FIG. 4. FIG. 7 is a cross-sectional side view of an illustrative phased antenna array 60 formed from a pattern of patch antennas (e.g., antennas of the types shown in FIGS. 5 and 6). As shown in FIG. 7, multiple patch antennas 40 may be arranged in antenna array 60. Antenna resonating elements 110 (sometimes referred to herein as antenna elements 110, elements 110, patch elements 110, or resonating elements 110) of respective patch antennas 40 may be formed at different locations over ground plane 112. While FIG. 7 shows a side view of array 60, array 60 may have patch antennas arranged in a two-dimensional grid pattern (e.g., arranged in a rectangular array pattern of rows and columns, arranged in a 5×5 array, etc.) or any other desired pattern. While FIG. 7 shows five patch antennas, this is merely illustrative. If desired, any number of patch antennas may be formed in array 60. The example of antenna elements 110 being patch antenna elements is merely illustrative. Antenna resonating elements 110 may be dipole antenna resonating elements, Yagi antenna resonating elements, or antenna resonating elements of any other desired type.

Respective transmission lines 92 may couple a corresponding patch element 110 to transceiver circuitry 28 (through substrate 120). Transmission lines 92 may also couple transceiver circuitry 28 to ground 112. As an example, ground 112 may be shared between multiple antenna elements 110 in FIG. 7. Elements 110 may be formed on a dielectric substrate such as substrate 120. Substrate 120 may be a printed circuit, dielectric (e.g., plastic, ceramic, foam, glass, etc.) support structure, or any other suitable structure on which elements 110 may be formed.

As previously described, array 60 may be located at any desired location 50 in FIGS. 2 and 3, for example. In order to protect array 60 from damage, dust, water, and other contaminants and for the purposes of mechanical reliability of the antenna assembly, a dielectric cover layer such as cover layer 122 (sometimes referred to as cover 122 or dielectric cover 122) may be formed over array 60. The dielectric properties and the geometry of cover layer 122 may affect the radiation characteristics of array 60. Cover 122 may sometimes be referred to herein as radome 122.

As shown in FIG. 7, cover layer 122 may be separated from patch elements 110 of array 60 by a gap such as gap G. Gap G may be filled with a dielectric material such as plastic, foam, air, etc. Cover 122 may be formed from any desired dielectric material. As examples, cover 122 may be formed from plastic, glass, ceramics, fiber composites, a combination of two or more of these materials, or any other suitable materials. Cover 122 may be formed from a portion of housing 12 (e.g., from a dielectric antenna window portion of housing 12 or other dielectric portions of housing 12) or any other dielectric structures of device 10. If desired, some or all of cover 122 may be formed from internal structures within device 10 (e.g., internal printed circuits, dielectric support structures, etc.) as an example.

In the example of FIG. 7, dielectric cover 122 has a uniform thickness T across the lateral area of array 60. Thickness T may be defined by planar lower surface 124 and planar upper surface 126. Surfaces 124 and 126 may lie in parallel planes with respect to a surface of elements 110, a surface of substrate 120, and/or a surface of ground 112. As an example, cover 122 may completely encapsulate elements 110 and/or a top surface of substrate 120. In other words, cover 122 and substrate 120 may form a closed cavity in which elements 110 are located. Surface 124 may sometimes be referred to herein as an inner surface, whereas surface 126 may sometimes be referred to herein as an outer surface (e.g., because inner surface 124 faces antennas 40 whereas outer surface 126 may, in some scenarios, be formed at the exterior of device 10).

During operation of antennas 40 in array 60, the transmission and reception of signals such as millimeter wave signals may be affected by the presence of cover 122 (e.g., by the geometry of cover 122 with respect to elements 40 and by the dielectric properties of cover 122). In particular, signals generated by array 60 may be reflected at the air-solid interfaces of cover 122 (e.g., at surfaces 124 and 126 which may be referred to as air-solid interface surfaces 124 and 126, interfacial surfaces 124 and 126, or interfaces 124 and 126). As a result, only a portion of signals generated by array 60 may be transmitted through cover 122. Additionally, the reflected portion of the transmit signals of array 60 may distort other transmit signals of array 60 (e.g., reflected signals that are 180 degrees out of phase with transmitted signals may destructively interfere with the transmitted signals). For example, if care is not taken, in the presence of flat cover 122 in FIG. 7 the peak gain of the signals transmitted by array 60 may be deteriorated, the radiation pattern of the signals generated by array 60 may be narrowed (e.g., to provide an excessively small wireless coverage area), the radiation pattern of the signals generated by array 60 may be otherwise distorted, etc. It may therefore be desirable to provide dielectric covers that can mitigate these adverse effects.

In the example of FIG. 7, the size of gap G may be selected, the thickness T of cover 122 may be selected, and/or the dielectric material used to form cover 122 may be selected to minimize these adverse effects. In particular, thickness T of cover 122 may be an optimal thickness such that the respective reflected signals generated at surfaces 124 and 126 interfere with each other destructively (e.g., cancel each other out). In other words, out-of-phase reflected signals (e.g., signals that have an approximately 180-degree phase difference with respect to each other) generated at surface 124 and 126 may cancel each other out. The optimal thickness in this example may be determined by the wavelength of the signals propagating through cover 122 and the dielectric constant of cover 122. As an example, an optimal thickness of cover 122 may be the wavelength of operation of array 60 divided by two, or any other desired thickness that minimizes distortion of the radiation pattern. However, in some configurations it may be difficult to select the size of gap G and type of dielectric material 122 to sufficiently mitigate these effects. Additionally, the planar inner surface 124 of cover 122 may receive incident signals transmitted by array 60 at relatively high incident angles (e.g., at an angle close to parallel with respect to interfacial surfaces 124 and 126), which can be more conducive to interfacial reflection of the incident signals than for signals that reach the interfacial surfaces at relatively low incident angles (e.g., at an angle close to parallel with the normal axis of surfaces 124 and 126).

In order to mitigate the distortion of the radiation pattern for antenna signals by the dielectric cover, the dielectric cover may include one or more curved inner surfaces. The curved inner surfaces may help to reduce the incident angle of the signal beam generated by steering array 60. This consequently lowers interfacial reflection of the incident signals, resulting in the transmission of more of the antenna signals through the dielectric cover relative to scenarios where the dielectric cover has a planar inner surface (e.g., cover 122 in FIG. 7).

Figure 8:
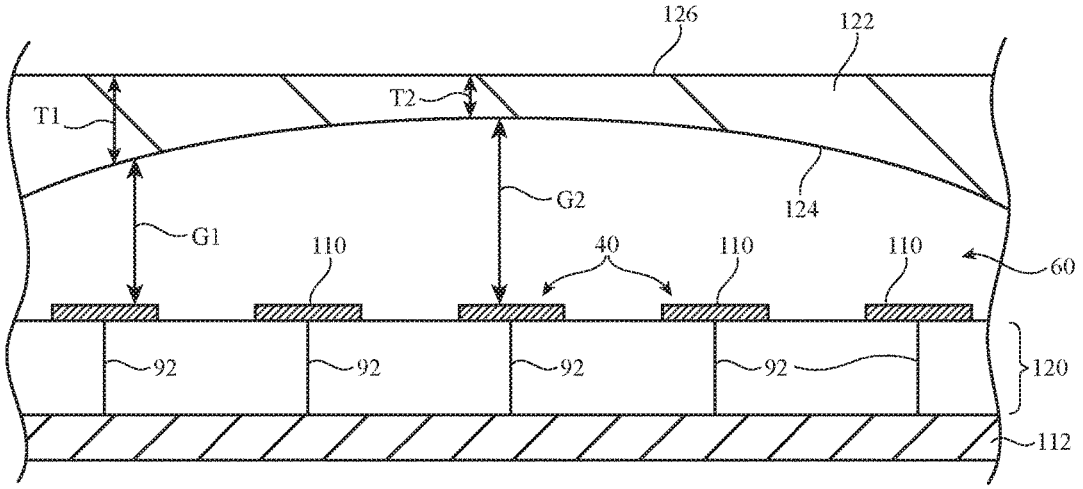
FIG. 8 is a cross-sectional side view of an illustrative dielectric cover having a curved inner surface formed over an antenna array in accordance with an embodiment.

As an example, FIG. 8 shows a cross-sectional side view of an illustrative dielectric cover 122 for array 60 that has a curved inner surface such as curved inner surface 124 and planar outer surface 126. Curved inner surface 124 may, for example, have a spherical curvature, an elliptical curvature, or any other desired type of curvature. Because inner surface 124 is curved, cover 122 may exhibit a variable thickness across its lateral area. For example, the edge portions (in the side view in FIG. 8) of cover 122 around the periphery of array 60 may be thicker than a center portion of cover 122 over the center of array 60. In other words, thickness T1 at the edges of cover 122 may be greater than thickness T2 at the center of cover 122. Consequently, elements 110 may be separated from cover 122 by a larger gap G2 near the center of array 60 and separated by a smaller gap G1 near the edges of array 60. This is merely illustrative. If desired, curved inner surface 124 may have a convex curve or any other suitable curvature.

Curved inner surface 124 of cover 122 in FIG. 8 may help to lower the incident angles at which signals transmitted by patch antennas 40 reach surface 124. By lowering the incident angle of the transmit signals, interface reflection at surface 124 may be decreased and consequently a larger portion of the millimeter wave signals generated by array 60 may be transmitted through cover 122 than if a dielectric cover having a planar inner surface was used. Additionally, concave surface 124 of cover 122 may function as a concave lens for antennas 40 in array 60 and help broaden the radiation pattern of the signal beam transmitted by array 60.

The dielectric cover and antenna array may be placed at various locations within or on electronic device 10 that are adjacent to other internal structures or device housing structures. In order to adapt to the confines of the adjacent internal structures and/or housing structures (e.g., to the form factor of device 10) while minimizing high incident-angle reflections at the surfaces of the cover, both the inner surface and the outer surface of a dielectric cover may have curved surfaces. In one illustrative example, dielectric cover 122 may have a uniform thickness with curved upper and lower surfaces. In another illustrative example, dielectric cover 122 may have curved upper and lower surfaces and a non-uniform thickness (the degrees of curvature of the upper and lower surfaces may be different). If desired, the dielectric cover may include multiple discrete cavities (e.g., a corresponding cavity or curved lower surface for each respective antenna element 110 in array 60).

As discussed previously, high incident angles between signals from resonating elements 110 and inner surface 124 of radome 122 may result in high interfacial reflection levels. Curving one or more portions of inner surface 124 (as discussed in connection with FIG. 8) may mitigate distortions in the radiation pattern for the antenna signals by the dielectric cover. To further reduce the incident angle of the signal beam generated by steering array 60 and further lower interfacial reflection of the incident signals, array 60 may be curved in addition to dielectric cover 122 (resulting in the transmission of more of the antenna signals through the dielectric cover relative to scenarios where the array is planar). An arrangement of this type is shown in FIG. 9.

Figure 9:
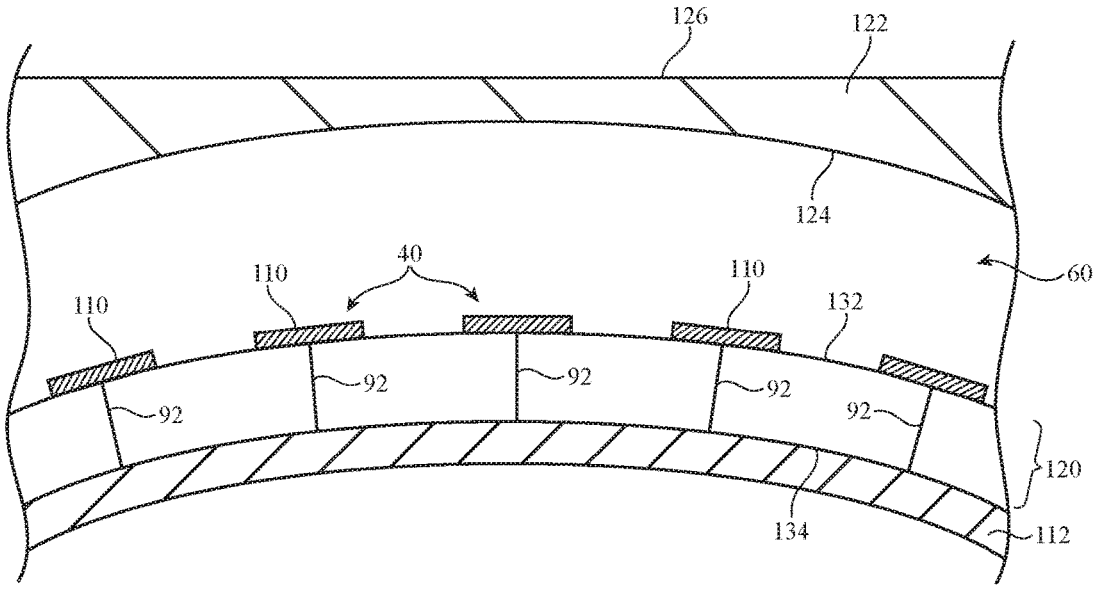
FIG. 9 is a cross-sectional side view of an illustrative antenna array with a curved substrate in accordance with an embodiment.

As shown in FIG. 9, substrate 120 with antenna resonating elements 110 may be curved. Substrate 120 may have an upper surface 132 that is curved. If desired, the curvature of upper surface 132 may be the same as the curvature of lower surface 124 of the dielectric cover (e.g., lower surface 124 of the dielectric cover may be parallel to upper surface 132 of the substrate 120). In FIG. 9, lower surface 134 of substrate 120 is shown as being curved (e.g., lower surface 134 may have curvature that matches the curvature of upper surface 132). However, this example is merely illustrative and lower surface 134 may instead be planar. Substrate 120 may therefore have a varying thickness if desired.

Bending substrate 120 of antenna array 60 may be desirable to improve antenna performance. However, in some configurations substrate 120 may be formed from a fairly rigid material, thus making it difficult to bend substrate 120 as desired. Therefore, to enable bending of substrate 120 for improved antenna performance, portions of substrate 120 may be etched to promote bending.

Figure 10:
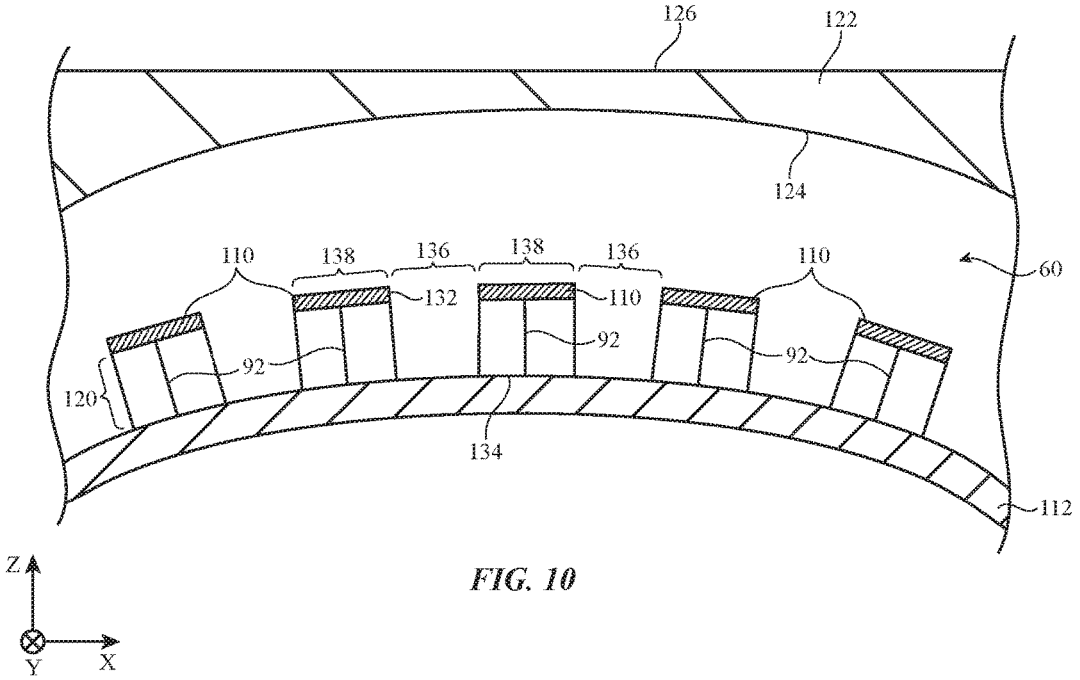
FIG. 10 is a cross-sectional side view of an illustrative antenna array with a curved substrate that has portions removed to promote bending in accordance with an embodiment.

An arrangement where substrate 120 is etched to promote bending is shown in FIG. 10. As shown in FIG. 10, substrate 120 for antenna array 60 may be etched in regions (e.g., regions 136) between resonating elements 110. Portions of the substrate 120 underneath resonating elements 110 (e.g., portions 138) may not be etched. The remaining portions 138 of substrate 120 may have a curved upper surface 132 and curved lower surface 134. If desired, the upper surface 132 and/or the lower surface 134 of substrate 120 may be planar (with the curvature of the underling ground layer 112 resulting in the signals from resonating elements 110 having a low incident angle on lower surface 124).

Figure 11:
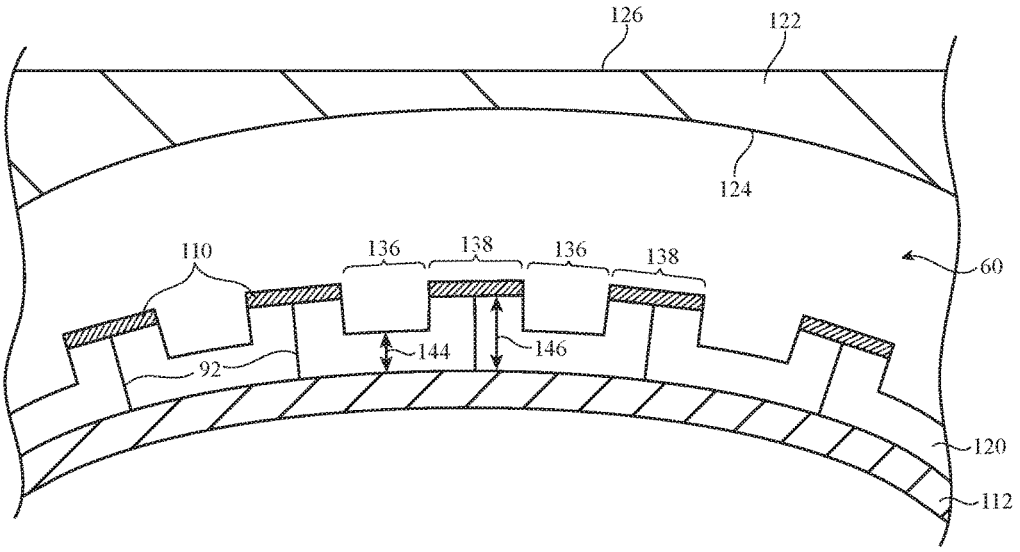
FIG. 11 is a cross-sectional side view of an illustrative antenna array with a curved substrate that has partially etched portions in accordance with an embodiment.

In FIG. 10, substrate 120 is totally removed in regions 136 between antenna resonating elements 110 (e.g., no portions of the material of substrate 120 may remain in regions that are not overlapped by resonating elements 110). However, this example is merely illustrative. If desired, substrate 120 may be partially etched in regions 136 between resonating elements 110. An arrangement of this type is shown in FIG. 11. Regions 136 may therefore sometimes be referred to as etched regions 136. As shown in FIG. 11, substrate 120 has a thickness 144 in etched regions 136 and a thickness 146 in portions (regions) 138 that have not been etched. Thickness 146 may be greater than thickness 144. Thickness 144 of each etched portion of substrate 120 may be the same across the substrate or may vary across the substrate. For example, the thickness of the substrate between first and second resonating elements 110 may be different or the same as the thickness of the substrate between second and third resonating elements 110.

Figure 12:
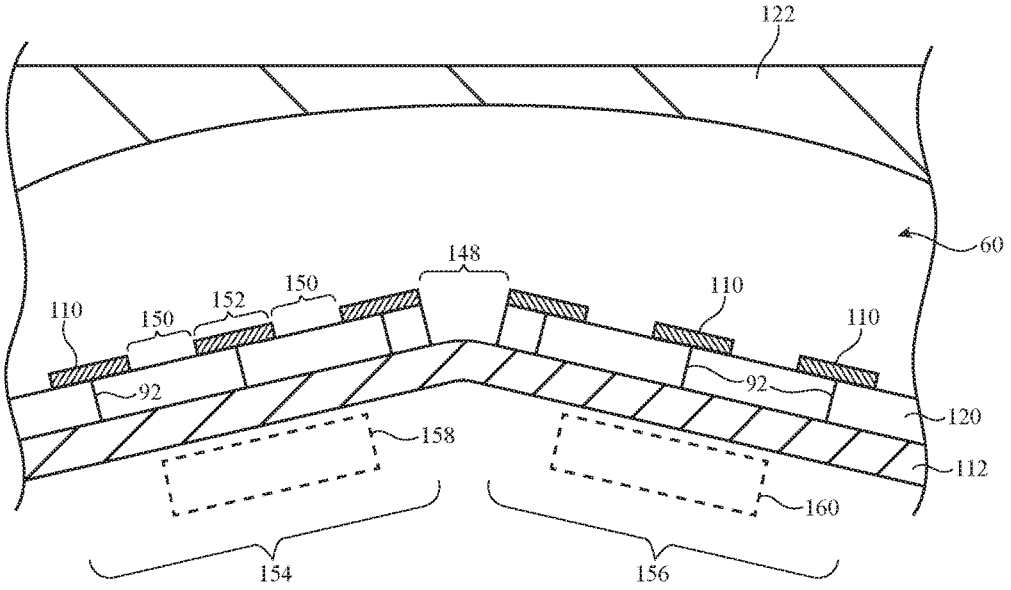
FIG. 12 is a cross-sectional side view of an illustrative antenna array with a single etched portion in accordance with an embodiment.

In the examples of FIGS. 10 and 11, all portions of substrate 120 that are not underneath an antenna resonating element 110 are depicted as being etched. However, these examples are merely illustrative. FIG. 12 shows an arrangement where a portion of substrate 120 is etched in region 148 to promote bending in region 148 (e.g., etched region 148). However, additional portions 150 of the substrate that are interposed between antenna resonating elements 110 are not etched. Similarly, portions of substrate 120 underneath antenna resonating elements 110 (e.g., portions 152) may be un-etched. Etching substrate 120 in this way may result in substrate 120 (and underlying ground layer 112) remaining planar in regions 154 and 156. The reduced substrate thickness in etched region 148 may result in ground layer 112 bending in region 148, with the bend interposed between planar portions 154 and 156. This may be allow components such as components 158 and 160 (e.g., rigid components that should not be bent) to be included underneath the planar portions of ground layer 112 and substrate 120.

Components 158 and 160 may each be any desired type of component. Component 158 and/or 160 may be an integrated circuit or integrated circuit package. For example, component 158 and/or 160 may be an integrated circuit used to form radio-frequency transceiver circuitry such as millimeter wave transceiver circuitry 28 (FIG. 1) that is used to convey signals to resonating elements 110 using transmission lines 92. Component 158 and/or 160 may be a rigid structural component (e.g., a frame or support plate) that cannot easily bend. Component 158 and/or 160 may be a rigid printed circuit board. In some embodiments, component 158 and/or 160 may be an input-output component or form portions of an input-output component (e.g., input-output devices 18 in FIG. 1) such as a button, camera, speaker, status indicator, light source, light sensor, position and orientation sensor (e.g., an accelerometer, gyroscope, compass, etc.), capacitance sensor, proximity sensor (e.g., capacitive proximity sensor, light-based proximity sensors, etc.), fingerprint sensor, etc.

Figure 13:
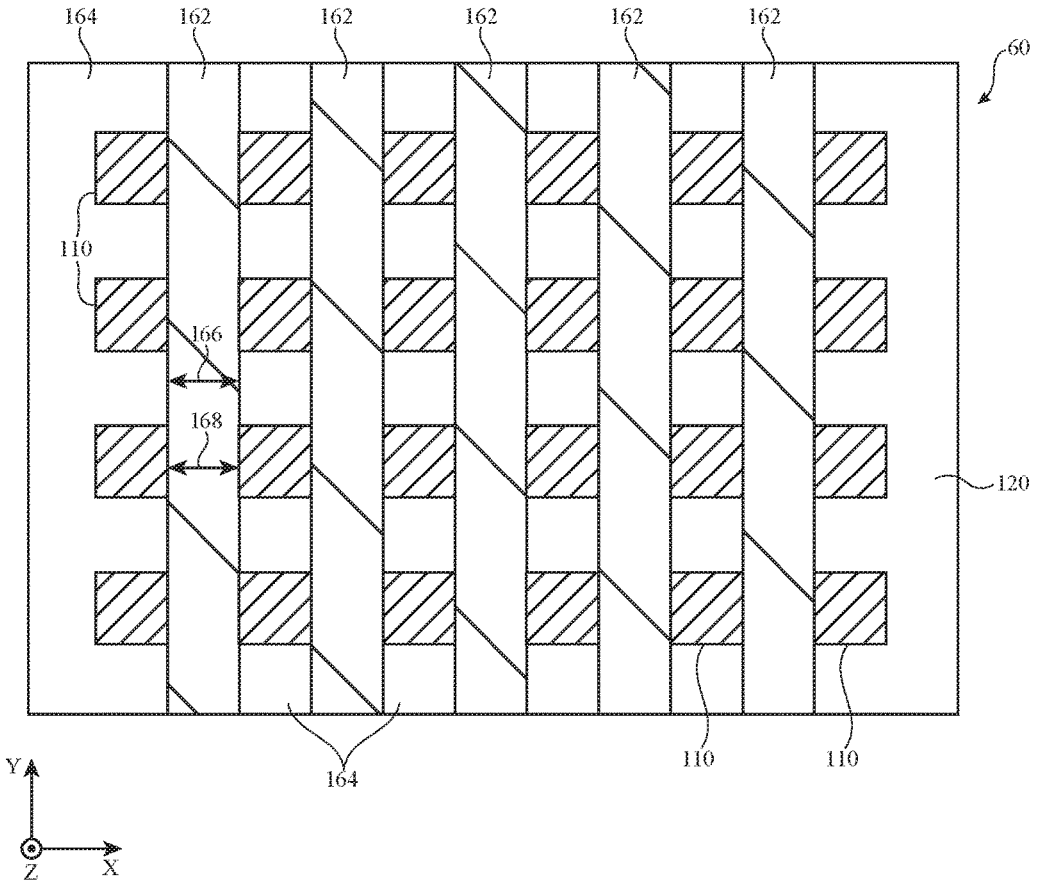
FIG. 13 is a top view of an illustrative antenna array with etched portions interposed between respective columns of antenna resonating elements in accordance with an embodiment.

FIGS. 13-17 are top views of illustrative phased antenna arrays with etched substrates. As shown in FIG. 13, substrate 120 may support an array of antenna resonating elements 110. Substrate 120 has a number of etched regions 162 between antenna resonating elements 110. Etched regions 162 of substrate 120 have a smaller thickness than regions of substrate 120 that have not been etched (e.g., portions 164). In some cases, the substrate 120 may be completely removed in etched regions 162 (e.g., the thickness of the substrate may be 0). An arrangement of this type is also shown in FIG. 10, as an example. In other cases, substrate 120 may not be completely removed in etched regions 162 (e.g., the thickness of the substrate in etched regions 162 may be greater than 0 but less than the thickness of the substrate in regions 164). An arrangement of this type is shown in FIG. 11, as an example.

In FIG. 13, each etched region 162 runs between two columns of antenna resonating elements 110 (e.g., parallel to the Y-axis). Each etched region may include all portions of substrate 120 between antenna resonating elements 110. In other words, the width (166) of each etched region 162 may be the same as the distance (168) between adjacent antenna resonating elements 110. The example of FIG. 13 is merely illustrative, and substrate 120 may include one or more etched regions of any desired depth, thickness, and shape.

Figure 14:
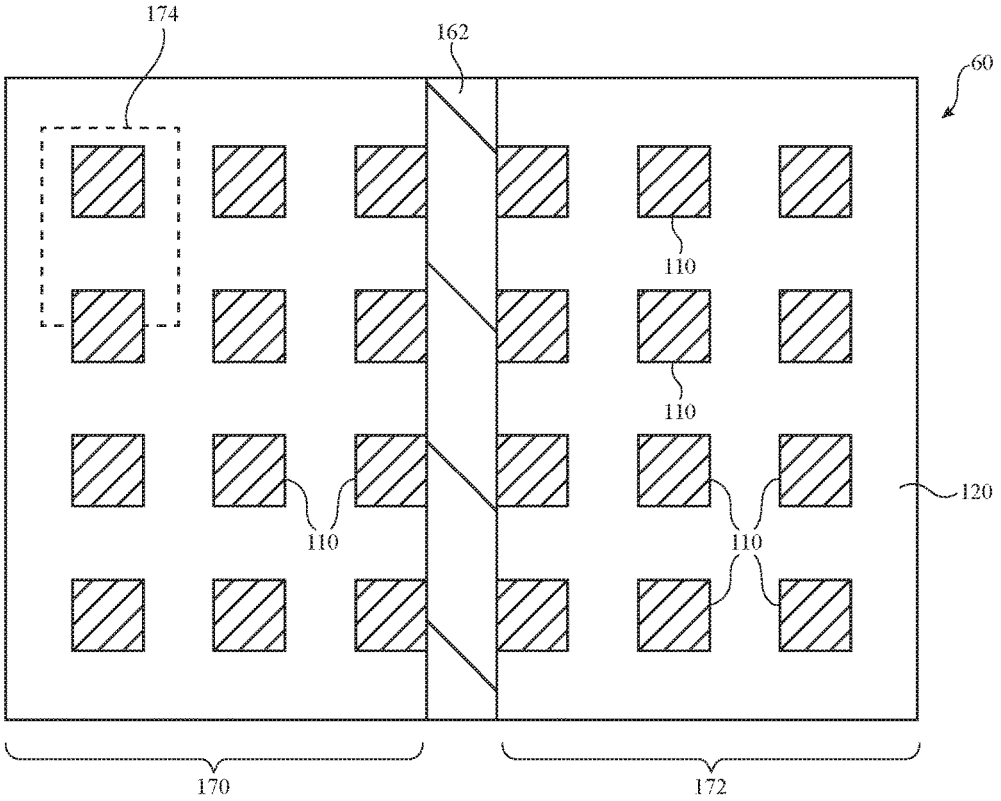
FIG. 14 is a top view of an illustrative antenna array with an etched portion that has a width that is equivalent to a distance between adjacent antenna resonating elements in accordance with an embodiment.

In another possible arrangement shown in FIG. 14, there may be only one etched region 162 in substrate 120. An arrangement of this type is shown in FIG. 12, as an example. In FIG. 13 (where multiple etched regions are present), each etched region may have a corresponding bend axis. This may result in substrate 120 (and the underlying ground layer) being bent along substantially the entire width of the substrate. In contrast, in FIG. 14 there may only be one bend (around etched region 162) in substrate 120 and the ground layer 112 (FIG. 12). Consequently, regions 170 and 172 of substrate 120 and the underlying ground layer may remain substantially planar (even when the substrate and ground layer are bent in etched region 162). This may allow an electronic component such as integrated circuit 174 to be included underneath substrate 120 without being bent.

Figure 15:
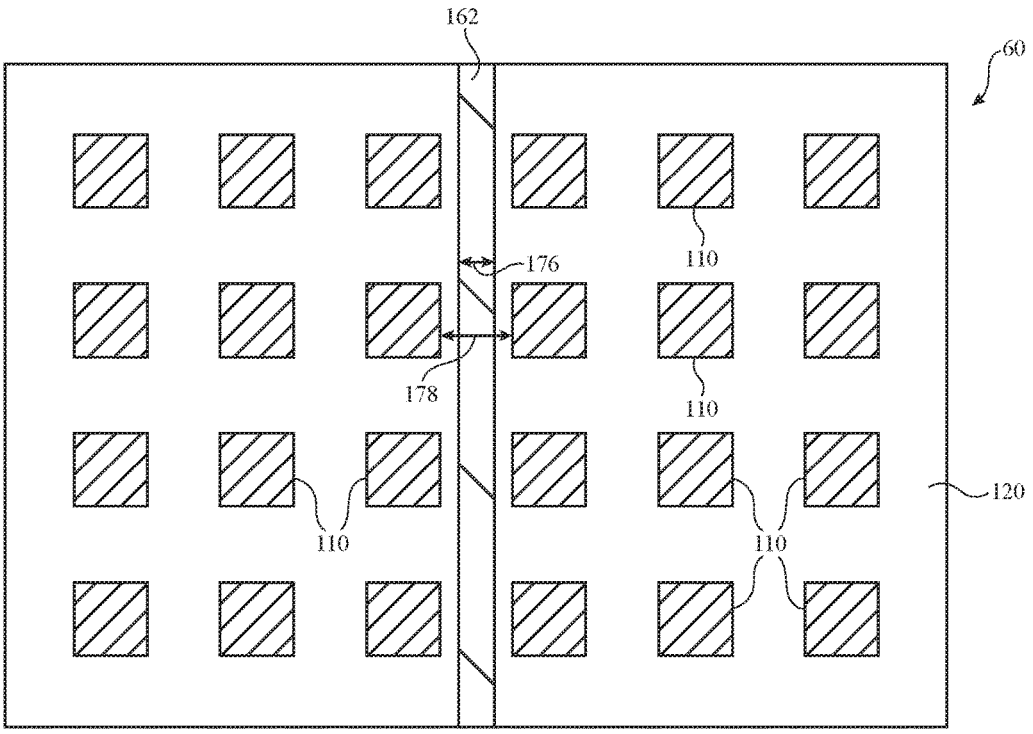
FIG. 15 is a top view of an illustrative antenna array with an etched portion that has a width that is less than a distance between adjacent antenna resonating elements in accordance with an embodiment.

In the examples of FIGS. 13 and 14, etched regions 162 have a width (e.g., width 166 in FIG. 13) that is the same as the distance between adjacent antenna resonating elements (e.g., distance 168 in FIG. 13). However, these examples are merely illustrative. If desired, the width of etched region 162 may be less than the distance between adjacent resonating elements. As shown in FIG. 15, etched region 162 may have a width 176 that is less than the distance 178 between adjacent resonating elements.

Figure 16:
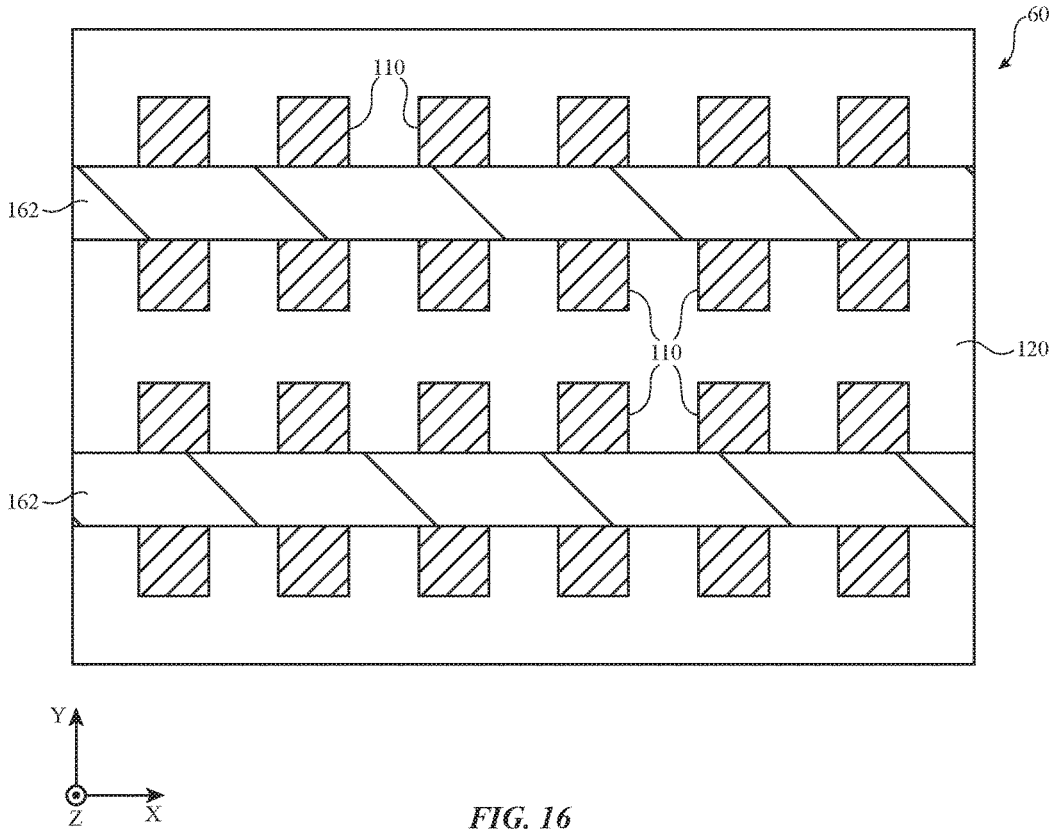
FIG. 16 is a top view of an illustrative antenna array with etched portions interposed between respective rows of antenna resonating elements in accordance with an embodiment.

In the examples of FIGS. 13-15, etched regions 162 run between adjacent columns of antenna resonating elements 110 (along the Y-axis as shown in FIG. 13). These examples are merely illustrative. If desired, etched regions 162 may run between adjacent rows of antenna resonating elements 110 (e.g., along the X-axis) as shown in FIG. 16. In the example of FIG. 16, two etched regions are included in substrate 120. In general, any desired number of etched regions may be included in substrate 120.

Figure 17:
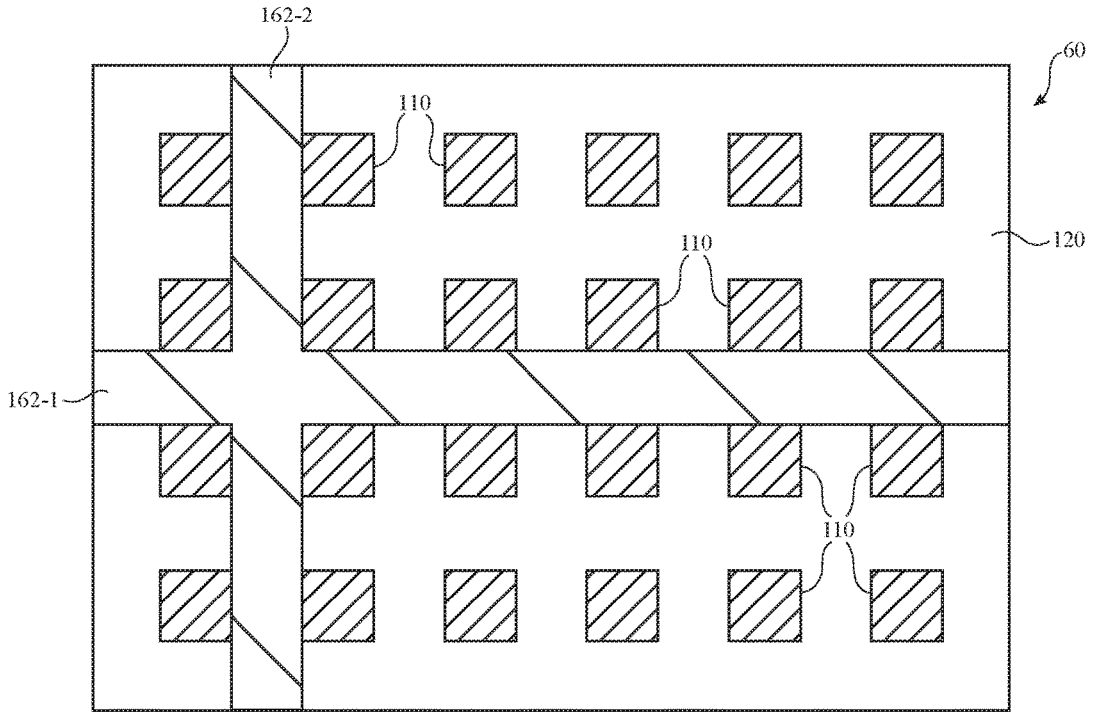
FIG. 17 is a top view of an illustrative antenna array with an etched portion interposed between adjacent rows of antenna resonating elements and an etched portion interposed between adjacent columns of antenna resonating elements in accordance with an embodiment.

FIG. 17 shows yet another possible configuration for a substrate (e.g., substrate 120) with etched regions. As shown in FIG. 17, substrate 120 may include a first etched region (such as etched region 162-1) that runs between adjacent rows of antenna resonating elements 110 and a second etched region (such as etched region 162-2) that runs between adjacent columns of antenna resonating elements 110.

The examples of FIGS. 13-17 are merely illustrative. If desired, substrate 120 may include any desired number of etched regions. Each etched region may have any desired width (e.g., equal to the distance between adjacent resonating elements or less than the distance between adjacent resonating elements) and any desired thickness (e.g., the thickness of the substrate may be 0 in the etched regions or the thickness of the substrate in the etched regions may be greater than 0 but less than the thickness of the substrate in the regions that are not etched). The examples of FIGS. 13-17 show arrangements where the etched regions extend completely across the substrate. However, the etched regions may have a shorter length such that the etched regions extend only partially across the substrate. Furthermore, the etched regions may extend in any desired direction. The example of FIGS. 13-17 where antenna resonating elements 110 are arranged in a grid with rows and columns of resonating elements is merely illustrative. Each resonating element 110 may have any desired location. The etched regions of the substrate may extend vertically, horizontally, or diagonally through the substrate. Additionally, the etched regions of the substrate may be curved or follow a meandering path if desired.

Some of the aforementioned embodiments refer to etched regions (e.g., etched regions 136 (FIG. 10), etched region 148 (FIG. 12), etched regions 162 (FIG. 13)) of substrate 120. These regions may be formed by etching substrate 120 (e.g., using photolithography techniques) or any other desired method. For example, the regions may be formed by using a mask during a deposition of substrate material or using a cutting tool. The regions may therefore sometimes be referred to as thinned regions (e.g., thinned regions 136 (FIG. 10), thinned region 148 (FIG. 12), thinned regions 162 (FIG. 13)), removed regions (e.g., removed regions 136 (FIG. 10), removed region 148 (FIG. 12), removed regions 162 (FIG. 13)), cavities, notches, recesses, grooves, dielectric-free regions (portions), and/or empty regions (portions).

As previously discussed, etching substrate 120 to allow bending may improve antenna performance (by reducing incident angle of signals from the phased array on an overlying dielectric cover). However, it may be desirable to bend substrate 120 for other reasons. For example, bending substrate 120 may allow antenna array 60 to fit in spaces within electronic device 10 that a planar array of the same area could not. This may allow valuable space within the electronic device to be used with maximum efficiency.

Figure 18:
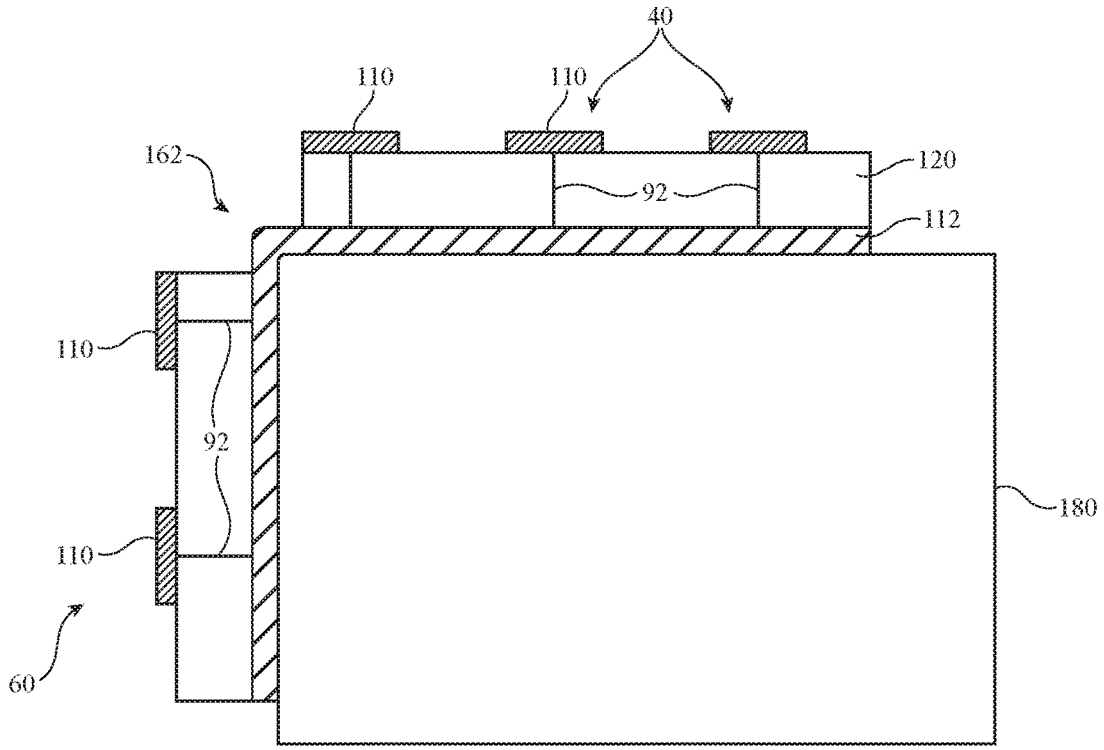
FIG. 18 is a side view of an illustrative antenna array and an additional component in an electronic device in accordance with an embodiment.

FIG. 18 shows a portion of an electronic device with a bent substrate 120. As shown in FIG. 18, substrate 120 and ground layer 112 of phased antenna array 60 may be bent around a component such as component 180. Substrate 120 may have a thinned region 162 that allows substrate 120 and ground layer 112 to bend (e.g., at a right-angle or any other desired angle) around a corner of component 180. Thinned region 162 may allow phased antenna array 60 to conform to the underlying component 180. Component 180 may be an integrated circuit. For example, component 180 may be an integrated circuit used to form radio-frequency transceiver circuitry such as millimeter wave transceiver circuitry 28 (FIG. 1) that is used to convey signals to resonating elements 110 using transmission lines 92. Component 180 may be a rigid structural component (e.g., a frame or support plate) that cannot easily bend. Component 180 may be a rigid printed circuit board. In some embodiments, component 180 may be an input-output component or form portions of an input-output component (e.g., input-output devices 18 in FIG. 1) such as a button, camera, speaker, status indicator, light source, light sensor, position and orientation sensor (e.g., an accelerometer, gyroscope, compass, etc.), capacitance sensor, proximity sensor (e.g., capacitive proximity sensor, light-based proximity sensors, etc.), fingerprint sensor, etc. Component 180 may also be part of a housing (e.g., housing 12 in FIG. 1) for an electronic device. For example, the phased antenna array 60 may be conformal to an exterior surface of a housing wall (e.g., a bent, angled, and/or curved housing wall) or the phased antenna array 60 may be conformal to the interior surface of a housing wall (e.g., a bent, angled, and/or curved housing wall).

Figure 19:
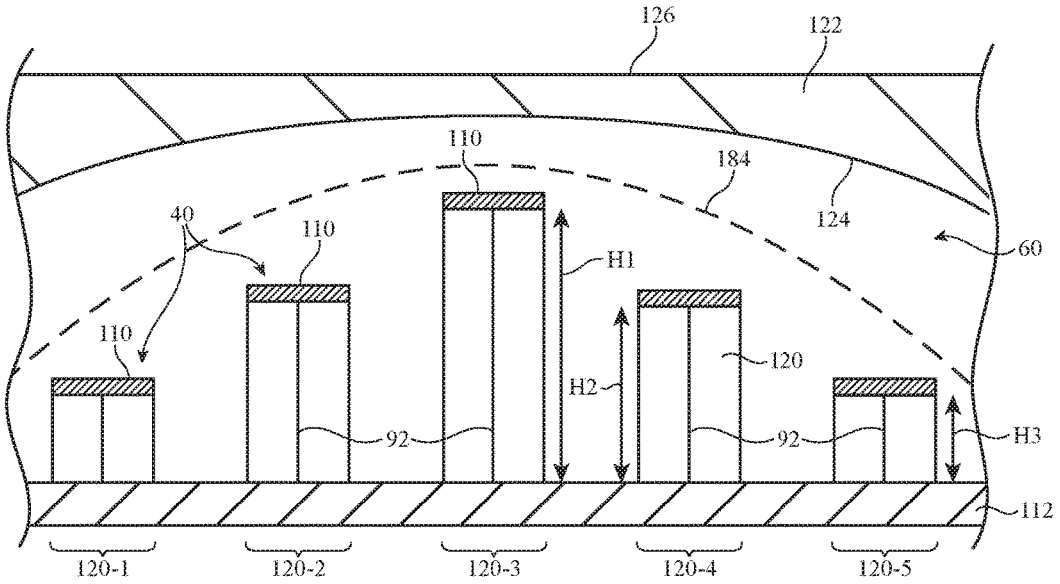
FIG. 19 is a cross-sectional side view of an illustrative antenna array with substrate portions of different heights under different antenna resonating elements in accordance with an embodiment.

Some of the aforementioned embodiments are directed towards etching the substrate of a phased antenna array to promote bending. However, substrate 120 may be etched even if the phased antenna array is not bent. FIG. 19 is a side view of a phased antenna array 60 with a substrate 120 that has been etched to have different heights. As shown, substrate portion 120-3 may have a first height H1, substrate portions 120-2 and 120-4 may have a second height H2 that is less than H1, and substrate portions 120-1 and 120-5 may have a third height H3 that is less than H2. Portions of substrate 120 may also be removed between antenna resonating elements 110. Each substrate portion may support at least one corresponding antenna resonating element. The heights of the substrate portions may result in antenna resonating elements 110 being arranged along an outline 184. Outline 184 may approximate a curve as shown in FIG. 19, reducing the incident angle of signals from antenna resonating elements 110 on lower surface 124 of dielectric cover 122. In general, the substrate portions may be etched such that outline 184 has any desired shape. Forming substrate 120 in this way may also let phased antenna array 60 be conformal to external objects that may be curved. The arrangement of FIG. 19 may be combined with any of the arrangements shown in FIGS. 10-18.

The foregoing is merely illustrative and various modifications can be made to the described embodiments. The foregoing embodiments may be implemented individually or in any combination.

What is claimed is:

1. An electronic device, comprising:

a phased antenna array including a plurality of antenna resonating elements on a dielectric substrate, wherein the dielectric substrate has a thinned region between first and second antenna resonating elements of the plurality of antenna resonating elements, the dielectric substrate has a first thickness in the thinned region, and the dielectric substrate has a second thickness that is greater than the first thickness in a portion of the dielectric substrate underneath the first antenna resonating element; and transceiver circuitry coupled to the phased antenna array and configured to convey antenna signals at a frequency greater than 10 GHz using the phased antenna array.

2. The electronic device defined in claim 1, wherein the thinned region between first and second antenna resonating elements comprises a notch in the dielectric substrate.

3. The electronic device defined in claim 1, wherein the phased antenna array includes a ground layer that is coupled to the dielectric substrate and that is bent at the thinned region of the dielectric substrate.

4. The electronic device defined in claim 1, further comprising:

a plurality of transmission line structures, wherein each transmission line structure of the plurality of transmission line structures is coupled to a respective antenna resonating element of the plurality of antenna resonating elements through the dielectric substrate.

5. The electronic device defined in claim 1, wherein the thinned region of the dielectric substrate is interposed between first and second planar portions of the dielectric substrate, the electronic device further comprising:

an electronic component formed under the first planar portion of the dielectric substrate.

6. The electronic device defined in claim 5, wherein the electronic component comprises an integrated circuit used to form the transceiver circuitry.

7. The electronic device defined in claim 1, wherein the plurality of antenna resonating elements comprises rows and columns of antenna resonating elements, the thinned region is one of a plurality of thinned regions of the dielectric substrate, and each thinned region of the plurality of thinned regions runs between respective adjacent columns of antenna resonating elements of the plurality of antenna resonating elements.

8. The electronic device defined in claim 1, wherein the plurality of antenna resonating elements comprises rows and columns of antenna resonating elements, the thinned region of the dielectric substrate runs between adjacent columns of antenna resonating elements of the plurality of antenna resonating elements, and the dielectric substrate includes an additional thinned region that runs between adjacent rows of antenna resonating elements of the plurality of antenna resonating elements.

9. The electronic device defined in claim 1, wherein the phased antenna array has a shape that conforms to an underlying component.

10. An electronic device, comprising:

a phased antenna array including a plurality of antenna resonating elements on a dielectric substrate, wherein the dielectric substrate has a thinned region between first and second antenna resonating elements of the plurality of antenna resonating elements; and transceiver circuitry coupled to the phased antenna array and configured to convey antenna signals at a frequency greater than 10 GHz using the phased antenna array, wherein the phased antenna array includes a ground layer coupled to the dielectric substrate, the thinned region of the dielectric substrate overlaps a portion of the ground layer, and no dielectric material of the dielectric substrate overlaps the portion of the ground layer.

11. The electronic device defined in claim 10, wherein a first portion of the dielectric substrate under the first antenna resonating element has a first thickness and a second portion of the dielectric substrate under the second antenna resonating element has a second thickness that is different than the first thickness.

12. An electronic device, comprising:

a phased antenna array including a plurality of antenna resonating elements on a dielectric substrate, wherein the dielectric substrate has a thinned region between first and second antenna resonating elements of the plurality of antenna resonating elements; and transceiver circuitry coupled to the phased antenna array and configured to convey antenna signals at a frequency greater than 10 GHz using the phased antenna array, wherein the dielectric substrate has a plurality of additional thinned regions between respective adjacent antenna resonating elements of the plurality of antenna resonating elements.

13. The electronic device defined in claim 12, further comprising:

a dielectric cover that is formed over the plurality of antenna resonating elements and that has a curved inner surface; and a ground layer having a curved upper surface that is coupled to the dielectric substrate.

14. An antenna array comprising:

a dielectric substrate;

a ground layer coupled to the dielectric substrate;

an array of antenna elements on the dielectric substrate, wherein the dielectric substrate has an etched portion between first and second antenna elements of the array of antenna elements and the ground layer is bent at the etched portion of the dielectric substrate; and a plurality of transmission line structures, wherein each transmission line structure of the plurality of transmission line structures is coupled to a respective antenna element of the array of antenna elements through the dielectric substrate.

15. The antenna array defined in claim 14, further comprising:

transceiver circuitry coupled to the plurality of transmission line structures and configured to convey antenna signals at a frequency greater than 10 GHz using the array of antenna elements and the plurality of transmission line structures.

16. The antenna array defined in claim 14, further comprising:

a dielectric cover having a curved inner surface formed over the array of antenna elements.

* * * * *